United States Patent [19]

Terayama et al.

[11] Patent Number: 4,523,685

[45] Date of Patent: Jun. 18, 1985

[54] REVOLVING BLOCK FOR HIGH PLACE WORKING VEHICLE

[75] Inventors: Fusaji Terayama; Tetsuo Kohzai; Naoyuki Murai, all of Osaka, Japan

[73] Assignee: Morita Fire Pump Mfg. Co., Ltd., Osaka, Japan

[21] Appl. No.: 612,780

[22] Filed: May 22, 1984

[30] Foreign Application Priority Data

Nov. 30, 1983 [JP] Japan ..... 58-227306

[51] Int. Cl.[3] ..... B66C 23/78

[52] U.S. Cl. ..... 212/247; 212/253

[58] Field of Search ..... 212/175, 179-182, 212/189, 245-249, 253; 74/813 R, 826; 248/349, 637, 647, 678

[56] References Cited

U.S. PATENT DOCUMENTS

| | | | |
|---|---|---|---|
| 1,316,907 | 9/1919 | McEwen | 248/349 |
| 1,531,982 | 3/1925 | Sago | 212/248 |
| 2,132,184 | 10/1938 | Poche | 212/247 |
| 3,608,756 | 9/1971 | Guinot | 212/189 |
| 4,309,854 | 1/1982 | Vendramini | 212/267 |

FOREIGN PATENT DOCUMENTS

| | | | |
|---|---|---|---|
| 1145492 | 10/1957 | France | 212/247 |

*Primary Examiner*—Trygve M. Blix
*Assistant Examiner*—Stephen P. Avila
*Attorney, Agent, or Firm*—Armstrong, Nikaido, Marmelstein & Kubovcik

[57] ABSTRACT

A revolving block with an inclination correcting mechanism housed therein for a high place working vehicle having a working implement such as a revolving ladder or boom mounted thereon.

4 Claims, 5 Drawing Figures

REVOLVING BLOCK FOR HIGH PLACE WORKING VEHICLE

BACKGROUND OF THE INVENTION

This invention relates to a revolving block for a high place working vehicle having a working implement such as a revolving ladder or boom mounted thereon, and more particularly it relates to a revolving table having an inclination correcting mechanism housed therein.

In this type of high place working vehicles, it is necessary to secure safety of operation by ensuring that the revolving type working implement operates always in a vertical place. Therefore, if the vehicle is placed on the inclined ground, the inclination of the working implement must be corrected somehow. As for the method of correcting the inclination of the boom on the revolving table, it is known to provide a separate correcting device adapted to ensure that the boom operates in a vertical plane, or to utilize the outrigger to make the entire vehicle horizontal. In the case of the former known method, however, the vehicle remains inclined and hence the revolving table remains inclined while the inclination of the boom alone is corrected, so that each time the position of revolution changes, a correcting operation is required, which is irrational. Further, the addition of the separate correcting device complicates the whole structure and involves an increase in cost. With the latter known conventional method, when the vehicle is made horizontal by the outrigger, the front or rear wheels are separated from the ground, so that it is required that the outrigger be rugged and have a sufficient stroke to raise the vehicle. Further, from the standpoint of safety of operation when the wheels are lifted in the air, the attaching position of the outrigger is limited and hence the design of the high place working vehicle is complicated.

SUMMARY OF THE INVENTION

This invention is intended to provide a revolving block for a high place working vehicle adapted to correct the inclination of the revolving type working implement while allowing the vehicle to remain inclined and without the need to add any separate device.

Thus, it is an object of this invention to provide a revolving block for a high place working vehicle having an inclination correcting mechanism housed therein.

A revolving block for a high place working vehicle according to this invention comprises a first annular body fixed on the body of the high place working vehicle and having an axis perpendicular to the vehicle body, a second annular body consisting of a lower portion coaxially and relatively rotatably assembled with the first annular body and an upper portion having a rotary axis obliquely crossing the rotary axis of the lower portion, a third annular body consisting of a lower portion coaxially and relatively rotatably assembled with the upper portion of the second annular body and an upper portion having an axis which obliquely crosses the rotary axis of the lower portion of the third annular body and which is normally aligned with the axis of the first annular body, a fourth annular body coaxially and relatively rotatably assembled with the upper portion of the third annular body, a table fixed to the fourth annular body, a driving device for rotating the table relative to the third annular body, a rotation preventing device for preventing rotation of the table relative to the vehicle body during operation for correction, a first fixing device for fixing the first and second annular bodies to each other when desired, and a second fixing device for fixing the second and third annular bodies to each other when desired.

According to this invention, since the inclination of the revolving block itself is corrected, even if the position of revolution is changed the working implement on the revolving block is always in a vertical plane and hence it is not necessary to perform a correcting operation for each revolving operation. Therefore, the operation by the working implement on the high place working vehicle can be continued smoothly and stably. Further, becuase of the construction in which the revolving block itself houses the correcting mechanism, there is no need to add a special vehicle fixing device such as an outrigger or a separate correcting device and a rational design of high place working vehicles becomes possible.

These and other objects and features of this invention will become more apparent from the following description to be given with reference to the accompanying drawings.

DESCRIPTION OF THE PREFERRED EMBODIMENTS

Figure 1:
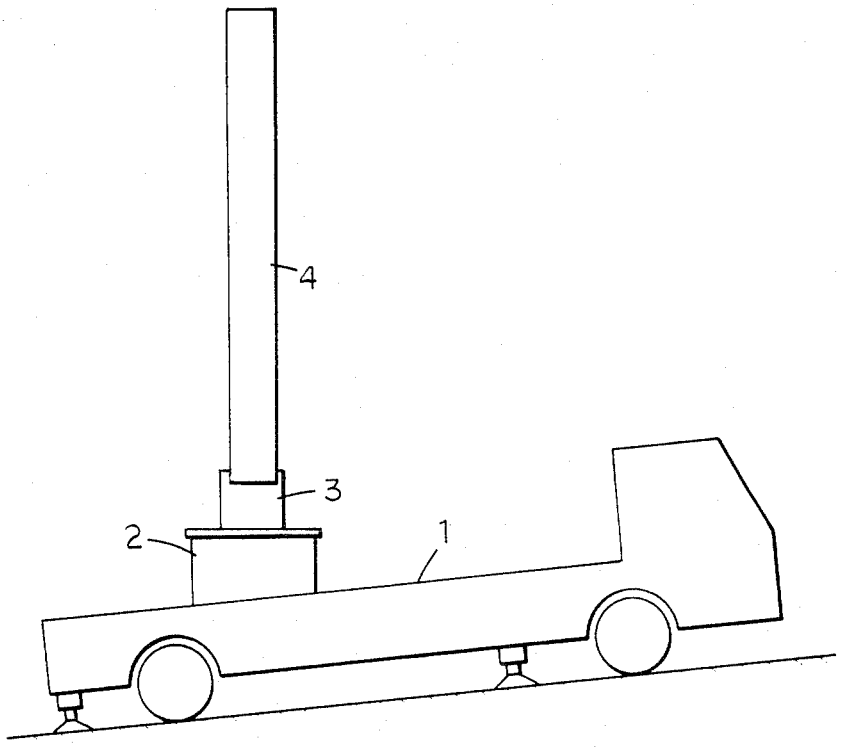
FIG. 1 is a schematic side view of a high place working vehicle equipped with a revolving block according to this invention, the vehicle being on the inclined ground.
Figure 3:
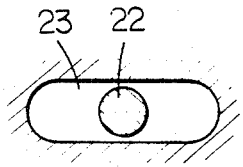
FIG. 3 is a view taken along the line III—III of FIG. 2A

Referring first to FIG. 1 showing a high place working vehicle equipped with a revolving boom, a revolving block 2 is installed on the rear portion of a vehicle body 1. A support frame 3 is fixed on the revolving block 2 and a boom 4 is pivotally connected at its proximal end to the support frame 3.

Figure 2A:
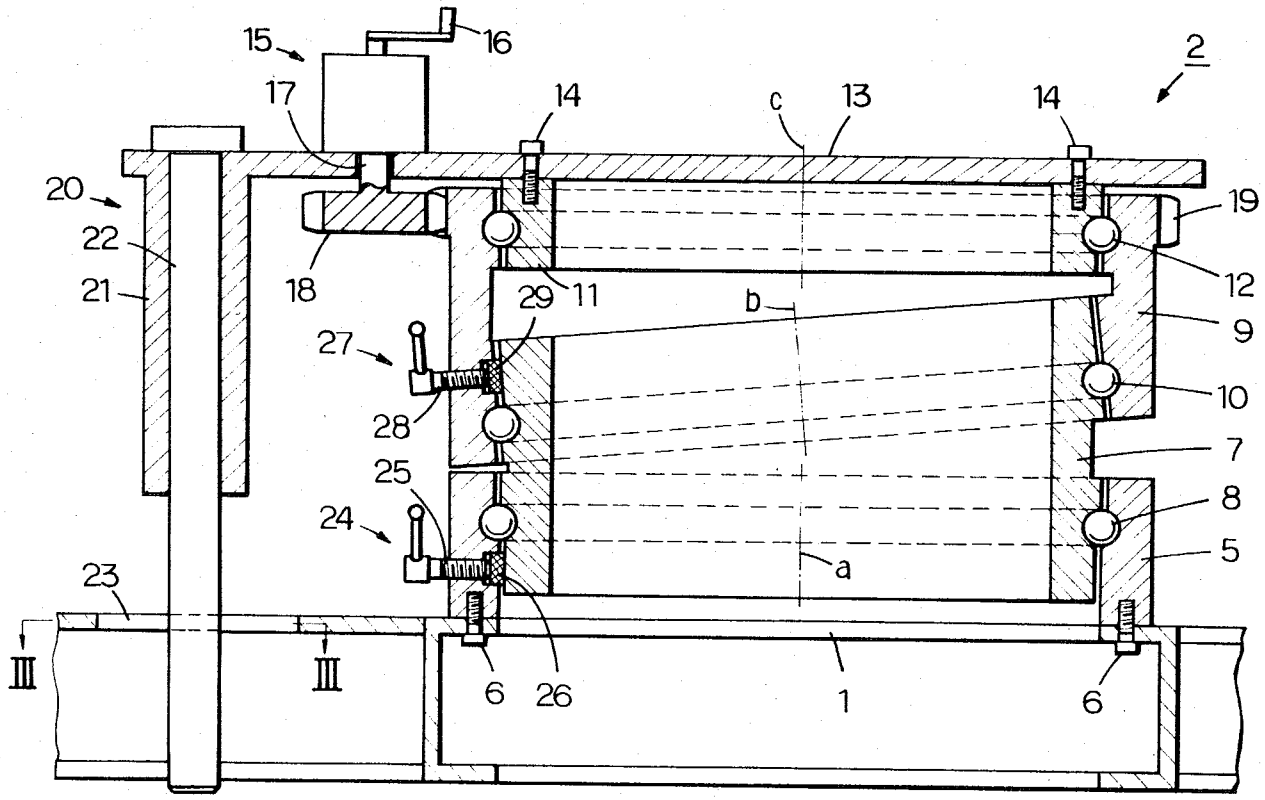
FIG. 2A is a vertical sectional view of a revolving block according to an embodiment of the invention.

The revolving block 2, as shown in FIG. 2A, includes four annular bodies 5, 7, 9, and 11. The first annular body 5 has a cylindrical inner peripheral surface parallel to an axis a extending perpendicularly to the vehicle body 1 and is fixed to the vehicle body 1 by suitable fastener means such as bolts 6. The second annular body 7 consists of a lower portion having a cylindrical outer peripheral surface parallel to the axis a, and an upper portion having a cylindrical outer peripheral surface parallel to an axis b obliquely crossing the axis a, the lower portion being coaxially and relatively rotatably assembled with the first annular body 5. The third annular body 9 consists of a lower portion having a cylindrical inner peripheral surface parallel to the axis b, and an upper portion having a cylindrical inner peripheral surface parallel to an axis c obliquely crossing the axis b, the lower portion being coaxially and relatively rotatably assembled with the upper portion of the second annular body 7. The fourth annular body 11 has a cylindrical outer peripheral surface parallel to the axis c and is integrally joined to a table 13 by suitable fastener means such as bolts 14. The upper portion of the third annular body 9 is coaxially and relatively rotatably assembled with the fourth annular body 11. The support frame 3 (FIG. 1) for supporting the boom 4 is fixed on the table 13. In the state prior to correction, or the normal state shown in FIG. 2A, the axes a and c are aligned with each other.

In the illustrated embodiment, rolling contact bearings 8, 9, and 10 are interposed between the inner peripheral surface of the first annular body 5 and the outer peripheral surface of the lower portion of the second annular body 7, between the outer peripheral surface of the upper portion of the second annular body 7 and the inner peripheral surface of the lower portion of the third annular body 9, and between the inner peripheral surface of the upper portion of the third annular body 9 and the outer peripheral surface of the fourth annular body 11, respectively. The use of such rolling contact bearings, however, is not essential for embodying this invention. In this connection, suffice it to say that it is possible to employ an equivalent arrangement which allows smooth relative rotation between adjacent annular bodies and which is capable of withstanding predetermined thrust loads without using rolling contact bearings.

In addition, according to the illustrated embodiment, the second annular body 7 is positioned inside the first and third annular bodies 5 and 9, but besides this, various combinations are possible; for example, the second annular body 7 may be positioned outside the first and third annular bodies 5 and 9. Further, the fourth annular body 11 may be positioned outside the third annular body 9 instead of inside the same as illustrated. In such case, a larger gear 19 to be later described may be formed on the inner peripheral surface of the third annular body 9.

A drive device 15 is attached to the table 13 and includes a rotary shaft 17 extending through the table 13 and having a handle 16 at its upper end and a smaller gear 18 at its lower end. The smaller gear 18 meshes with the larger gear 19 formed on the outer peripheral surface of the third annular body 9. The driving device 15 is used not only to rotate the table 13 and fourth annular body 11 relative to the third annular body 9 to correct the inclination of the revolving block 2 but also to revolve the table 13 relative to the vehicle body 1 upon completion of correction. In addition, the driving device 15 is not limited to the manual type as illustrated, and it is possible to employ an arrangement using an electric motor, hydraulic or pneumatic actuator. In that case, an inclination sensor may be attached to the table 13 so as to automatically perform the inclination correcting operation on the basis of signals from the sensor.

A rotation preventing device 20 is provided for preventing the table 13 from rotating relative to the vehicle body 1 during correction of inclination. The rotation preventing device 20 includes a pin 22 removably inserted in a sleeve 21 downwardly extending from the lower surface of the table 13 so that the lower end of the pin is loosely fitted in an elongated opening 23 formed in the vehicle body 1. The rotation preventing device 20 may be of other arrangement than the illustrated one so long as it is capable of selectively allowing and preventing the rotation of the table 13 relative to the vehicle body 1. For example, as in the aforesaid driving device, it is possible to make use of a hydraulic or pneumatic actuator.

A first fixing device 24 is provided for fixing the first and second annular bodies 5 and 7 to each other when desired. Various arrangements therefor may be contemplated, but the simplest arrangement is to utilize a fixing bolt 25 which is threadedly installed in the first annular body 5 so that it is movable back and forth in a direction perpendicular to the axis a. In this case, the mutual fixing of the first and second annular bodies 5 and 7 can be attained by tightening the fixing bolt 25 to urge a lining 26 hard against the second annular body 5. Similarly, a second fixing device 27 serves the purpose of fixing the second and third annular bodies 7 and 9 to each other when desired, and this device comprises a fixing bolt 28 which is threadedly installed in the third annular body 9 so that it is movable back and forth in a direction perpendicular to the axis b. In this case also, the mutual fixing of the second and third annular bodies 7 and 9 can be attained by tightening the fixing bolt 28 to urge a lining 29 hard against the second annular body 7. Of course, other arrangements may be employed. For example, if hydraulic or pneumatic pressure is utilized, this will contribute to automation of correction of inclination.

An inclination correcting operation using the revolving block 2 of the aforesaid arrangement will now be described by taking as an example an instance in which the vehicle body 1 is placed on the ground raised at the left side as shown in FIG. 1. For brevity of description, it is assumed that the angle between the axes a and b is equal to half the angle of inclination of the vehicle body.

In the state prior to correction shown in FIG. 2A, the fixing bolt 25 of the first fixing device 24 is loosened to cancel the fixing of the first and second annular bodies 5 and 7. Subsequently, the handle 16 of the driving device 15 is turned to rotate the rotary shaft 17, the third annular body 9 is rotated around the rotary axis c by smaller and larger gears 18 and 19 meshing with each other since the rotation of the table 13 is prevented by the rotation preventing device 20. With the rotation of the third annular body 9, the second annular body 7 integrally fixed thereto by the second fixing device 27 is also rotated. In brief, the third and second annular bodies 9 and 7 are rotated in a unit relative to the vehicle body 1 and table 13 around the axes a and c aligned with each other. When the second annular body 7 is rotated through 180° to reach the FIG. 2B state, the rotation of the handle 16 is stopped.

Figure 2B:
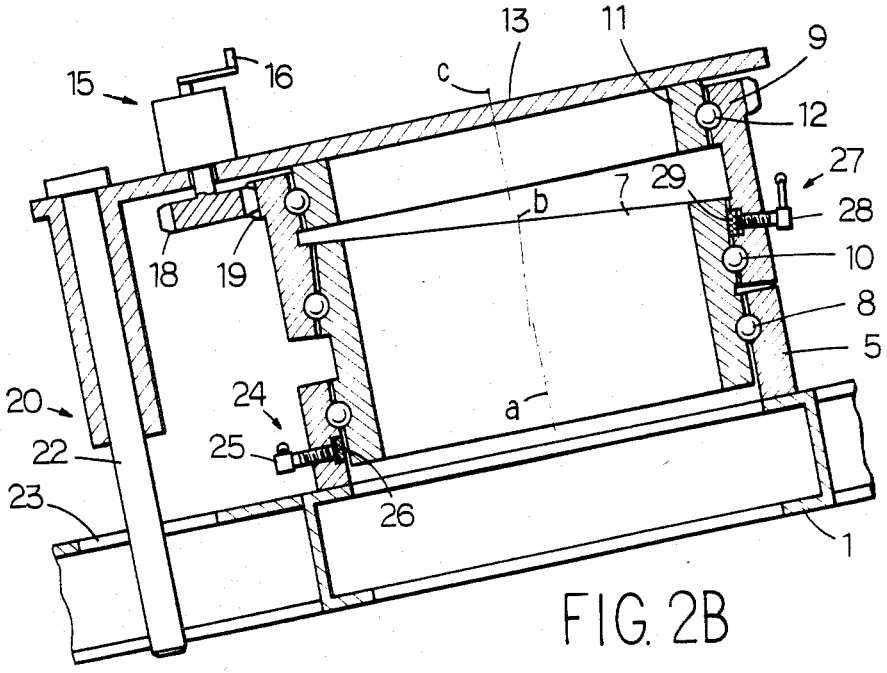
FIGS. 2B and 2C are vertical sectional views similar to FIG. 2A for explaining how to correct the inclination of the revolving block.
Figure 2C:
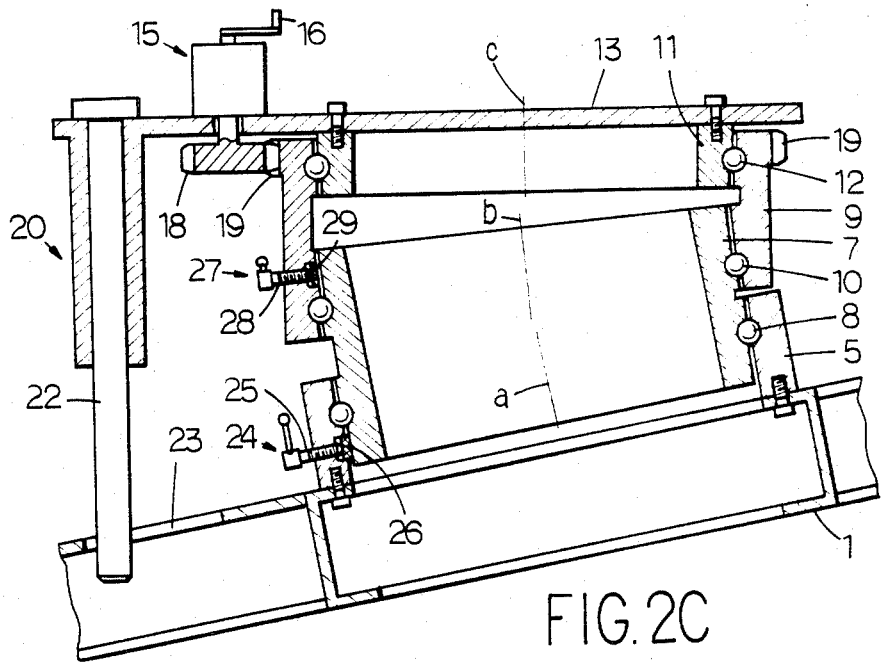

After the FIG. 2B state is established, the fixing bolt 25 of the first fixing device 24 is tightened to fix the first and second annular bodies 5 and 7 to each other whereas the fixing bolt 28 of the second fixing device 27 is loosened to cancel the fixing of the second and third annular bodies 7 and 9. Thereafter, the handle 16 of the driving device 15 is turned to rotate the third annular body 9 through 180° by the rotary shaft 17 and the smaller and larger gears 18 and 19. As a result, the third annular body 9, which is coaxially assembled with the upper portion of the second annular body 7 whose axis b crosses the axis c of the third annular body 9 and which is now fixed, is raised at the left side as viewed in the figure, so that the fourth annular body 11 and the table 13 are made horizontal (FIG. 2C).

When the correcting operation is thus completed, the fixing bolt 28 of the second fixing device 27 is tightened, whereby the third annular body 9 is fixed to the second annular body 7 and hence to the first annular body 5 which is integrated therewith by means of the first fixing device 24. As a result, the first through third annular bodies 5, 7, and 9 are fixed relative to the vehicle body 1. Thus, it is possible to revolve the table 13 through a desired angle in a vehical plane through the rotary shaft 17 and the smaller and larger gears 18 and 19 meshing with each other by turning the handle 16 of the driving device 15 after extracting the pin 22 to cancel the prevention of rotation of the tabale 13 imposed by the rotation preventing device 20. The foregoing description has been given on the assumption that the angle between the axes a and b is equal to half the angle of inclination of the vehicle body, as pointed out previously. This is the reason why the angle of rotation of the second annular body 7 during the first stage of correcting operation, i.e., the transition from the FIG. 2A state to the FIG. 2B state and the angle of rotation of the third annular body 9 are 180°, respectively. Actually, since the angle through which the third annular body 9 and/or the second annular body 7 must be rotated depends on the actual angle of inclination of the vehicle body 1, the annular body will be rotated until the table 13 becomes horizontal.

It will be obvious to those skilled in the art that the invention is not limited to the embodiment described and illustrated herein and that various changes and modifications may be made in the invention without departing from the spirit and scope thereof.

What is claimed is:

1. A revolving block for a high place working vehicle comprising:

a first annular body fixed on the body of the high place working vehicle and having an axis perpendicular to the vehicle body;

a second annular body consisting of a lower portion coaxially and relatively rotatably assembled with said first annular body and an upper portion having a rotary axis obliquely crossing the rotary axis of said lower portion;

a third annular body consisting of a lower portion coaxial and relatively rotatably assembled with the upper portion of said second annular body and an upper portion having a rotary axis which obliquely crosses the rotary axis of said lower portion of said third annular body and which is normally aligned with the axis of said first annular body;

a fourth annular body coaxially and relatively rotatably assembled with said upper portion of the third annular body;

a table fixed to the fourth annular body;

a driving device for rotating the table relative to the third annular body;

a rotation preventing device for preventing rotation of the table relative to the vehicle during correcting operation;

a first fixing device for fixing the first and second annular bodies to each other when desired; and a second fixing device for fixing the second and third annular bodies to each other when desired.

2. A revolving block as set forth in claim 1, wherein rolling contact bearings are interposed between said first and second annular bodies, between said second and third annular bodies, and between said third and fourth annular bodies, respectively.

3. A revolving block as set forth in claim 1, wherein said driving device is attached to said table and has a rotary shaft having a smaller gear on one end thereof, while said third annular body has a larger gear meshing with said smaller gear.

4. A revolving block as set forth in claim 1, wherein said rotation preventing device includes a removable pin extending through said table so that its lower end is loosely fitted in an elongated opening formed in the vehicle body.

* * * * *